US005909762A

United States Patent [19]

Denoual et al.

[11] Patent Number: 5,909,762

[45] Date of Patent: Jun. 8, 1999

[54] SECTIONAL CLOSING DOORS

[75] Inventors: Daniel Denoual, Saint Genevieve des Bois; Maurice Perroux, Saint Etienne, both of France

[73] Assignee: Fit Carrosserie SA, France

[21] Appl. No.: 08/987,542

[22] Filed: Dec. 9, 1997

[51] Int. Cl.[6] ..... E05D 15/06

[52] U.S. Cl. ..... 160/201; 160/235

[58] Field of Search ..... 160/201, 229.1, 160/232, 235, 40, 188, 189

[56] References Cited

U.S. PATENT DOCUMENTS

| | | | |
|---|---|---|---|
| 2,968,829 | 1/1961 | Meddick | 160/40 X |
| 3,067,814 | 12/1962 | Anthony . | |
| 3,118,702 | 1/1964 | Kale et al. | 160/201 X |
| 3,302,690 | 2/1967 | Hurd | 160/201 X |
| 4,095,641 | 6/1978 | Olson | 160/201 X |
| 4,532,973 | 8/1985 | DeFalco | 160/235 |
| 4,771,816 | 9/1988 | Clay, Jr. . | |
| 4,793,397 | 12/1988 | Whiteman | 160/201 |
| 4,924,932 | 5/1990 | Esnault | 160/201 |
| 4,979,553 | 12/1990 | Lowry, III et al. . | |
| 5,056,847 | 10/1991 | Stillwell et al. | 160/188 X |
| 5,365,993 | 11/1994 | Jella | 160/232 X |

FOREIGN PATENT DOCUMENTS 2072248 12/1980 United Kingdom .

OTHER PUBLICATIONS

International Search Report F337B5399 FR.

*Primary Examiner*—David M. Purol
*Attorney, Agent, or Firm*—Wall Marjama Bilinski & Burr

[57] ABSTRACT

A sectional door includes a plurality of consecutively coupled panels, each panel having at least one profiled form over at least a portion of a length of an end thereof, the at least one form defining a swivel joint between coupled panels. The panels, as coupled, can move between a vertical position and a horizontal position in order to allow door opening or closing. Preferably, the door includes a top panel, a bottom panel and a plurality of intermediate panels coupled there between in which each intermediate panel include a pair of profiled forms along at least part of the length thereof of each end. One of the forms includes an interior curved profile sized to allow the positioning and housing of connecting bars over at least a portion of the length of the profile, the connecting bars being associated to allow moving of all of the coupled panels. When the forms are coupled to define the swivel joint, a profiled matching part can be interlocked therein, the matching part constituting a rider made in one or more parts over the length of the coupled panels and forming a cover providing the closed finish of the formed swivel joint.

4 Claims, 7 Drawing Sheets

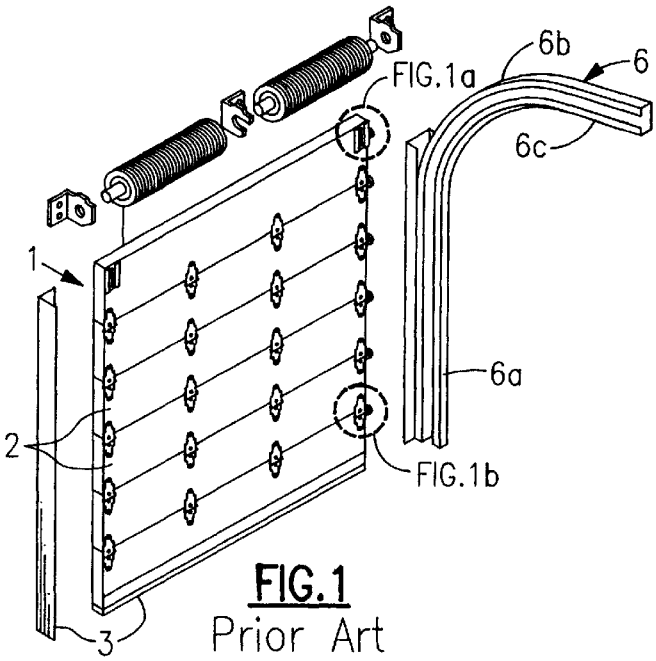
FIG.1
Prior Art
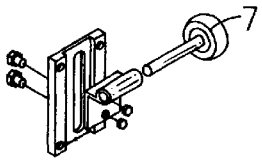
FIG.1a
Prior Art
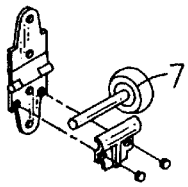
FIG.1b
Prior Art
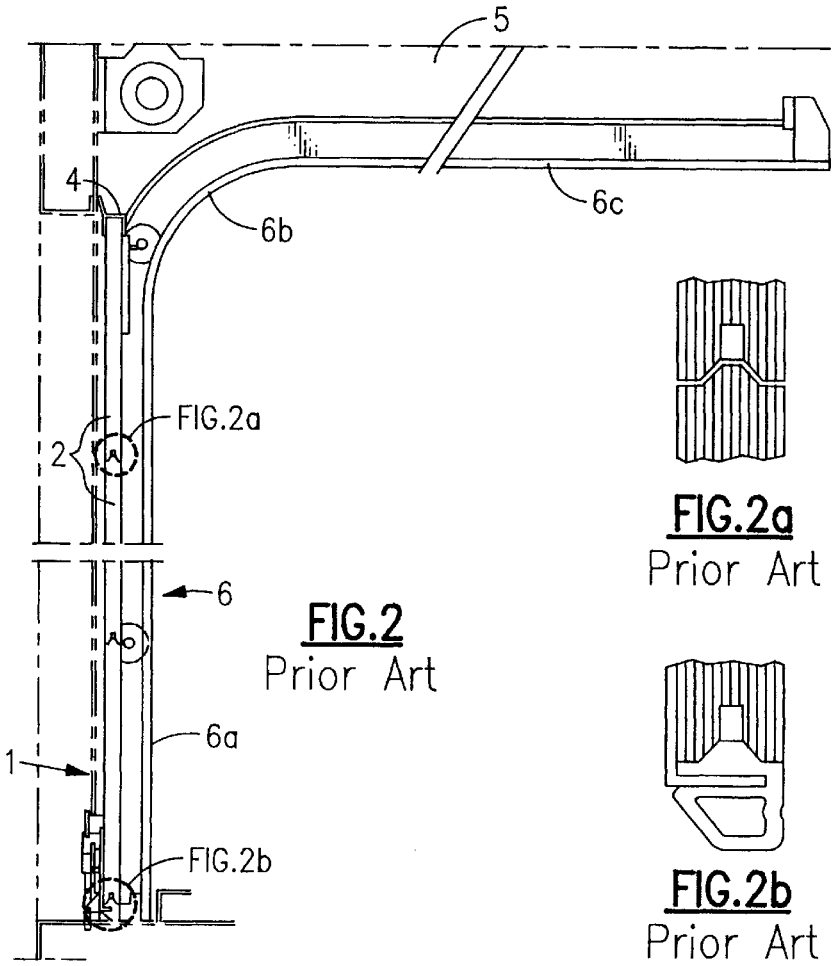
FIG.2
Prior Art
FIG.2a
Prior Art
FIG.2b
Prior Art

SECTIONAL CLOSING DOORS

BACKGROUND OF THE INVENTION

The invention relates to the technical sector of so-called sectional doors, i.e. doors that include several panels which are joined to each other and capable of sliding along guide profiles to ensure opening or closing of various locations which may be transported or not transported, such as goods vehicles or garages or other storage premises.

The concept of sectional panel doors is well known in many closing applications and is described in particular in document U.S. Pat. No. 4,979,553 incorporated herein by reference in it's entirety. These doors are designed with a plurality of panels made of wood, metal, plastic or other material that are connected to each other thanks to special interlocking shapes which allow them to move along guide rails having several profiles allowing transition from a vertical plane to a horizontal plane or vice versa in order to obtain closing or opening permitting access to the desired location.

In the non-exhaustive example of sectional doors used to close lorries shown in FIGS. 1 and 2 of the drawings, the guide rails are vertically fixed on uprights inside the platform of the vehicle chassis. These rails comprise a vertical part equivalent to the height of the opening and a radius of curvature with an extension as a horizontal rail part. The various panels of the door are made of wood, for example, and have matching rabbet profiles making it possible to fit a seal between the successive panel sections. In addition, there is provision at the ends of the upper panel, the lower panel and certain intermediate panels to position guide rollers capable of sliding in the running path formed on the rails. The rollers comprise a pin that is externally fixed to the section of the panels. This type of sectional door is described in particular in document GB-A-2 072 248.

Such doors of this design have many drawbacks. Firstly, the guide rollers are subjected to considerable stresses and they have to be replaced regularly. Once assembly has been completed, this change is relatively impractical. In addition, the panels are heavy and require powerful drive motors in order to move the door when opening or closing it. Also, it should be noted that any damage to one panel is extremely troublesome because this makes it necessary to disassemble the entire door rather than just the actual damaged panel.

SUMMARY OF THE INVENTION

The object sought after by the invention is therefore to use a new device to join and fix the panels that make up sectional doors.

Another object that is sought after is to produce a device which allows better protection of the associated guide rollers whilst allowing them to be replaced quickly in the event of damage.

These objects and others will become apparent from the description that follows.

According to a first aspect of the invention, the sectional closing door of the type comprising a plurality of panels each arranged with one or two profiled end forms permitting, after their coupling on two consecutive panels, the formation of a non-closed swivel joint of the panels between each other, the said panels being associated with means enabling them to be moved from a vertical position to a horizontal position in order to allow door opening or closing, characterised in that the said forms, arranged over all or part of the length of the panels, are profiled on the inside in order to allow, over all or part of their length, the positioning and housing of connecting bars associated with the means for driving and moving all of the said panels and in that the said forms are arranged in order to allow the reception and interlocking of a profiled matching part constituting a rider made in one or more parts over the length of the various panels and forming a cover providing the closed finish of the swivel joint.

BRIEF DESCRIPTION OF THE DRAWINGS

The object of the present invention is described, merely by way of example, in the accompanying drawings in which:

FIG. 1 is a schematic perspective view, prior to assembly, of a sectional door according to the prior art used for vehicle closing.

FIG. 2 is a schematic profile view according to the prior art showing the profile of the guide elements of the sectional door.

DETAILED DESCRIPTION OF THE INVENTION

Figure 3:
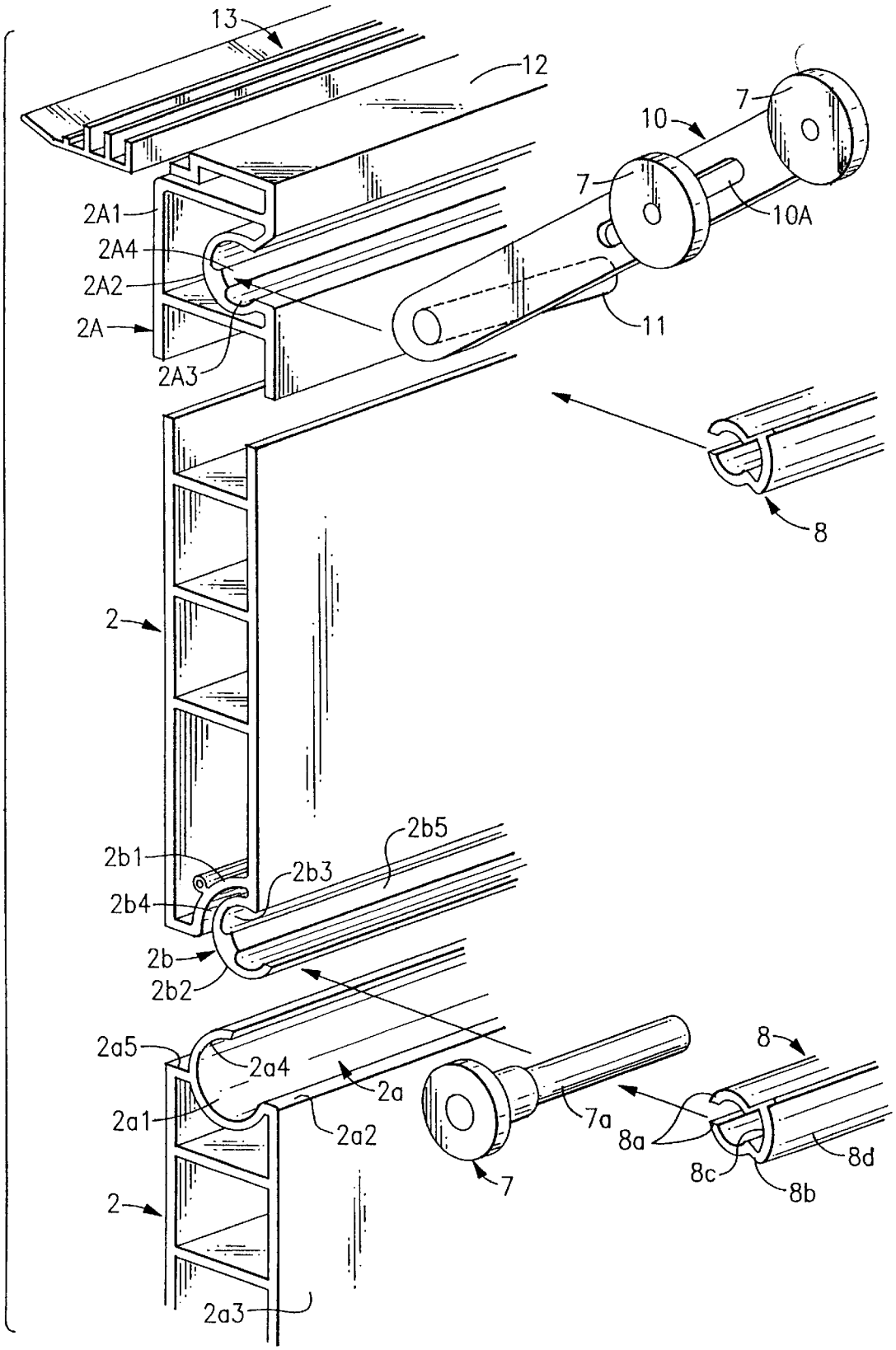
FIG. 3 is a partial, exploded perspective view showing the upper part of a sectional door according to the invention.

In order that the present invention may more readily be understood, the following description is given, merely by way of example, reference being made to the accompanying drawings.

As shown in FIGS. 1 and 2, the sectional door is referred to as (1) and comprises several consecutively mounted and coupled panels (2). The door is intended to be fitted in a frame (3) which may be the area where a goods vehicle is opened and loaded. The latter comprises a fixed upper lintel (4) and longitudinal walls (5) against which a guide rail (6) will be positioned that has a profile which allows sliding of rollers or wheels (7) associated with the panels into a position where the frame is completely closed or opened. The rail (6) has a vertical plane (6*a*), a radius of curvature (6*b*) and a horizontal plane (6*c*). An appropriate drive motor (not shown) of any known type is used to ensure the various movements.

Figure 5A:
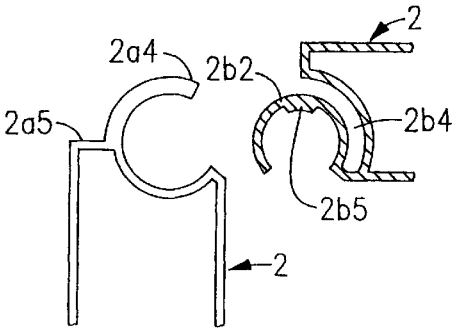
FIGS. 5*a*, 5*b* and 5*c* are schematic, partial views showing the principle used to join the panels to each other and their mounting.
Figure 5B:
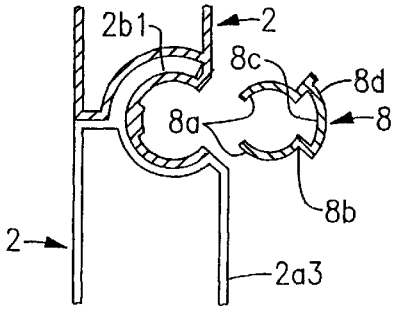
Figure 5C:
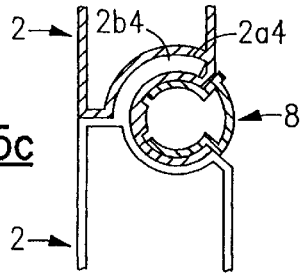
Figure 5:
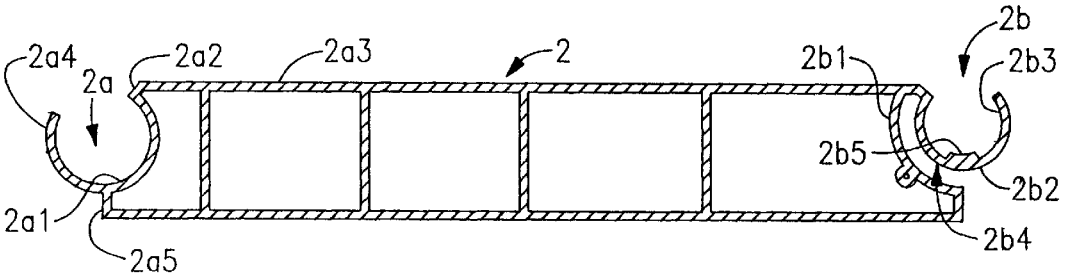
FIG. 5 is a transverse sectional view showing a panel according to the invention.
Figure 6:
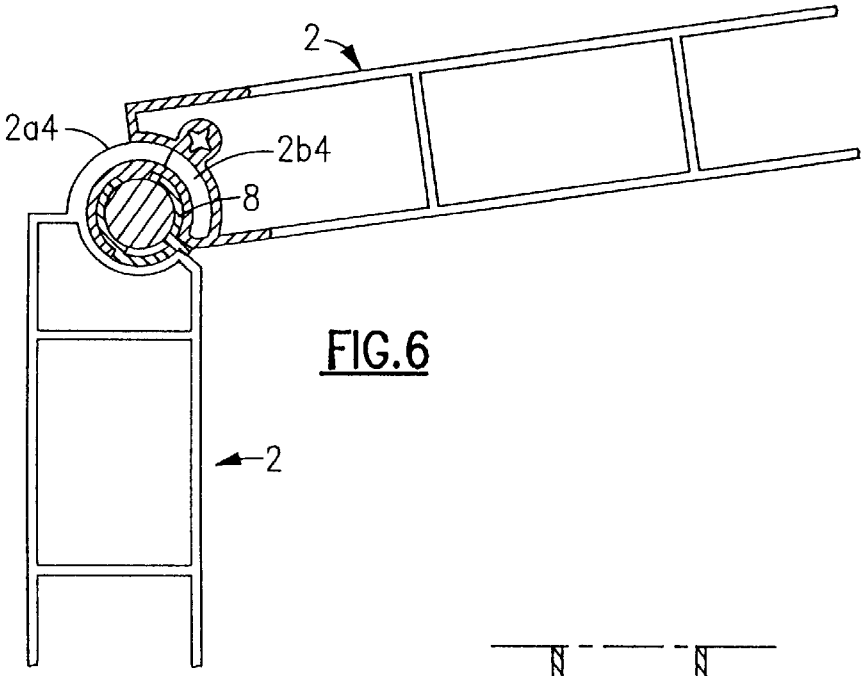
FIG. 6 is a view showing two consecutive joined panels.
Figure 7:
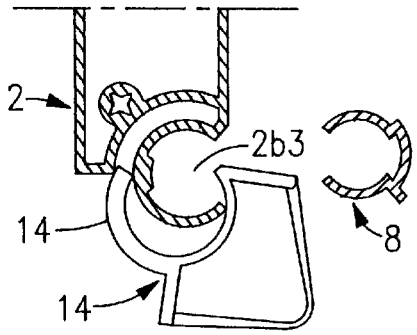
FIGS. 7 and 8 are partial views showing, by way of example, the use of the lower panel.
Figure 8:
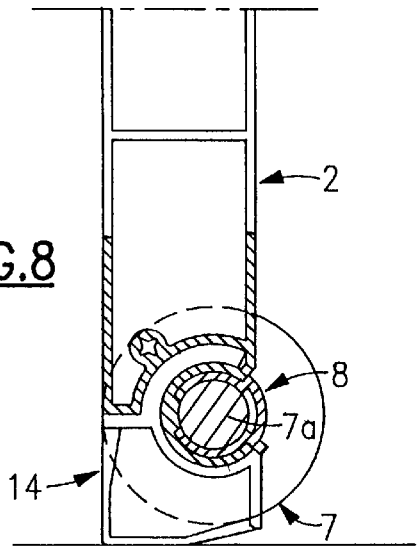

According to the invention and as shown in FIGS. 3 and 5, each panel (2), except an upper end panel (2A) and a lower end panel (2B) is made with two special, matching end forms (2*a*), (2*b*) permitting the formation of a non-closed swivel joint between each panel. These forms (2*a*), (2*b*) are produced over all or part of the length of the panels. A first form (2*a*) is made with an open, partially spherical part defined by an opening (2*a*-1). One of the ends of the opening (2*a*-2) connects to the outside plane (2*a*-3) of the panel, the other end (2*a*-4) of the opening protrudes from a side edge (2*a*-5). The spherical part is established in order to constitute a housing on the outside and the inside.

The other end (2*b*) of panel (2) is arranged with a curvilinear inside profile (2*b*-1) established by a substantially corresponding to the spherical part of the first panel end (2*a*) to constitute a support and reference plane. This curvilinear profile (2*b*-1) extends on the outside part of the panel (2) as an open substantially spherical shaped protruding part (2*b*-2) defined by an opening (2*b*-3) and a corresponding spherically shaped engagement slot (2*b*-4) forming a housing for the first end (2*a*-2) of the panel. The spherical shape of the protruding part (2*b*-2) and the slots (2*b*-4) are substantially in the same plane as the spherical part on the first end such that two consecutive panels are coupled by inserting the first spherical end (2*a*-4) in above-mentioned slot (2*b*-4) of the second end (2*b*) of the panel. According to one important arrangement, the openings (2*a*-1) and (2*b*-7) established on each of said spherical parts are identical and face each other when the consecutive panels are in axial alignment. The inside diameter of the protruding part (2*b*-2) is advantageously selected to allow positioning, centering and maintenance of pin (7*a*) of a guide rollers (7) of the above-mentioned type. The inside bottom (2*b*-5) of the spherically shaped protruding part (2*b*-2) has a projecting curvilinear form capable of the constituting a seat for the pin of above-mentioned rollers.

In order to ensure internal protection of the above-mentioned device, a matching part (8) is separately mounted forming a cover and, secondarily, constituting a roller support. This part is made in the form of a profiled rider having substantially U-shaped curved forms so that the matching part (8) can be fitted inside the above-mentioned spherical parts formed on the panels (27). As shown most particularly in FIG. 5(*c*), this part (8) forming a rider has wings (8*a*) forming lips capable of being joined relative with the bottom face (8*c*) of the rider because of the reduced thickness (8*b*) of the lips. The matching part is therefore elastic to a certain extent. Its outside face (8*d*) also has a spherical profile to interlock and accurately close the matching parts of the device. Referring to FIG. 3 the roller pin (7*a*) is securely held between the lips of the matching part (18) and the bottom (2*b*-5) of the spherical protruding part (2*b*-2) of the panel (2).

Said rider can be removed very easily, thus making it possible to grasp, if necessary, the roller pin (7*a*) in order to replace it. The matching part (8) is advantageously made with a length that corresponds substantially to, the length of the roller pin (7*a*). Two so-called "end" matching parts or riders (8) of this type are positioned at the location of each opposite roller pin (7*a*) relative to the ends of the panels (2). A long intermediate rider (9) then covers the remaining gap. Without extending beyond the scope of the invention, limit stop shapes can be made on certain panels in order to limit the extent to which the panels open out.

Figure 9:
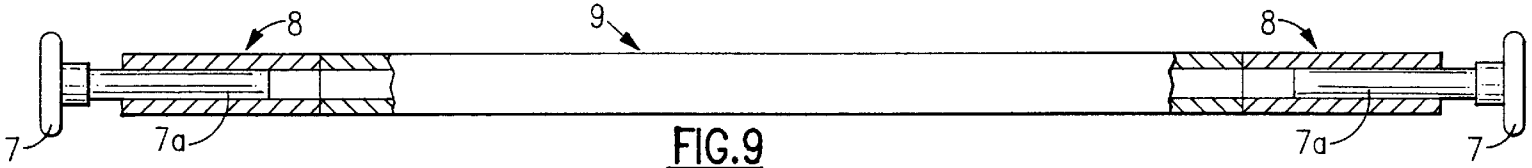
FIG. 9 is a longitudinal sectional view showing the protection of the guide roller pins when the doors are being closed or opened.
Figure 11:
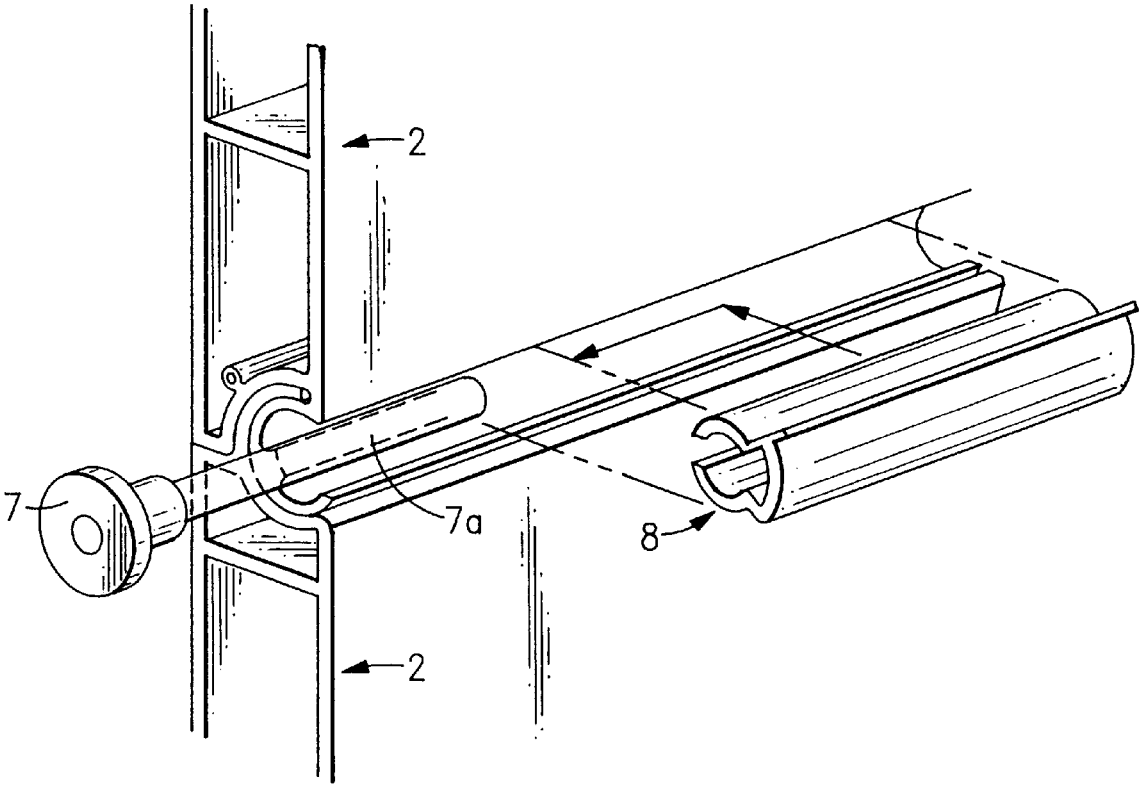
FIG. 11 is a perspective view showing the assembly and disassembly of the guide roller pins.

FIG. 11 shows the assembly and disassembly of the guide rollers (7). Once the successive panels (2) have been joined, the roller pin (7*a*) is positioned in the rail and in the inside opening of the swivel joint thus formed. A so-called "end" rider (8) is fitted in the joint zones of the panels (2) beyond the end of the roller pins (7*a*). By exploiting the elasticity of the lips or wings (8*a*) of the rider (8), the latter is inserted and then laterally slid towards the roller, thus enclosing the roller pin (7*a*). The same procedure is performed at both ends of the panels (2) using each of the end riders (8). The intermediate rider (9) FIG. 9 is then fitted in order to immobilise the assembly.

The sectional door is arranged with end shape(s) (2*a*–2*b*) of said internally profiled panels in order to allow, over all or part of their length, positioning and housing of the connecting bars associated with the means of driving and moving all the said panels between a horizontal position and a vertical position.

Figure 4:
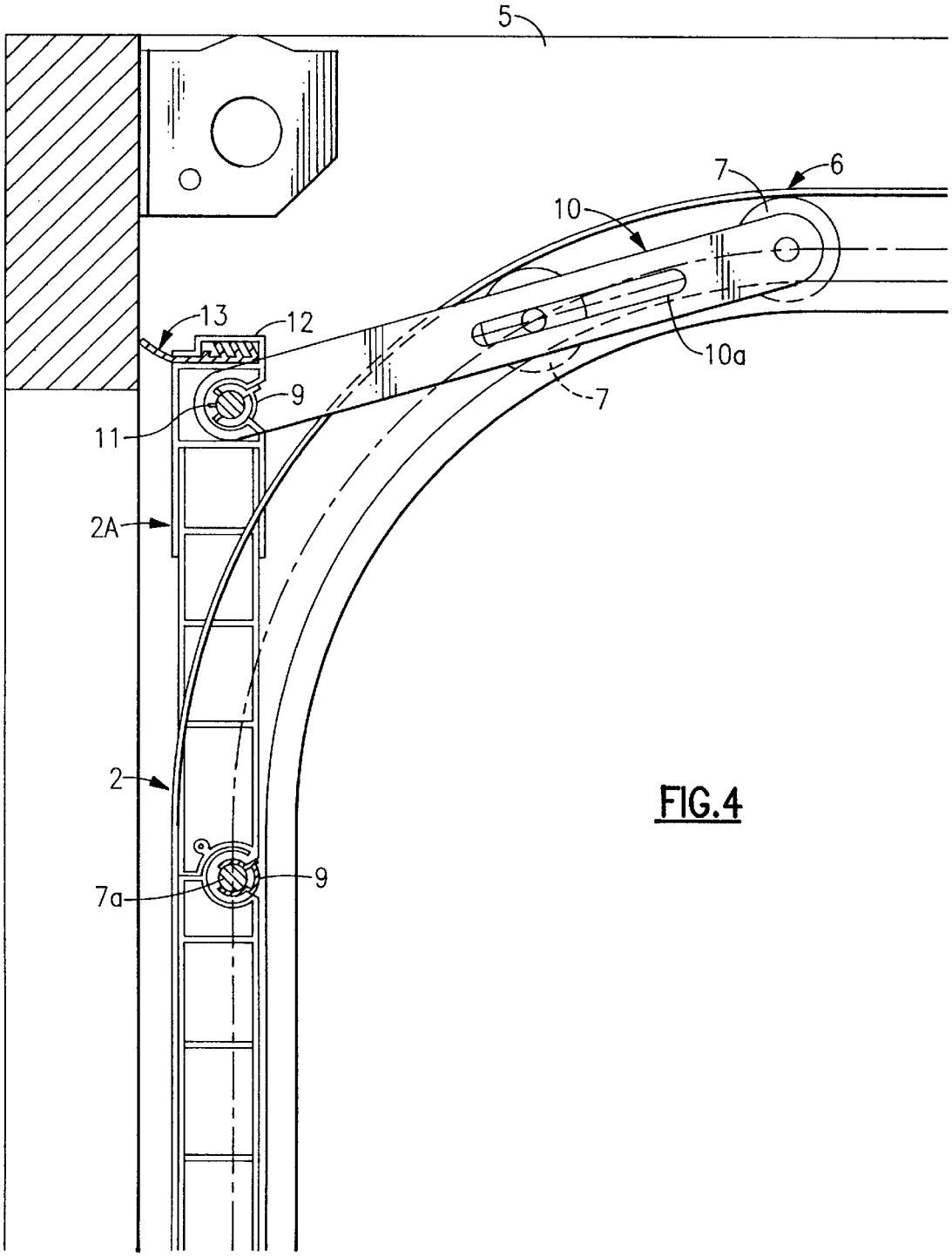
FIG. 4 is a partial sectional view showing the way the sectional door according to FIG. 3 is fitted.
Figure 10:
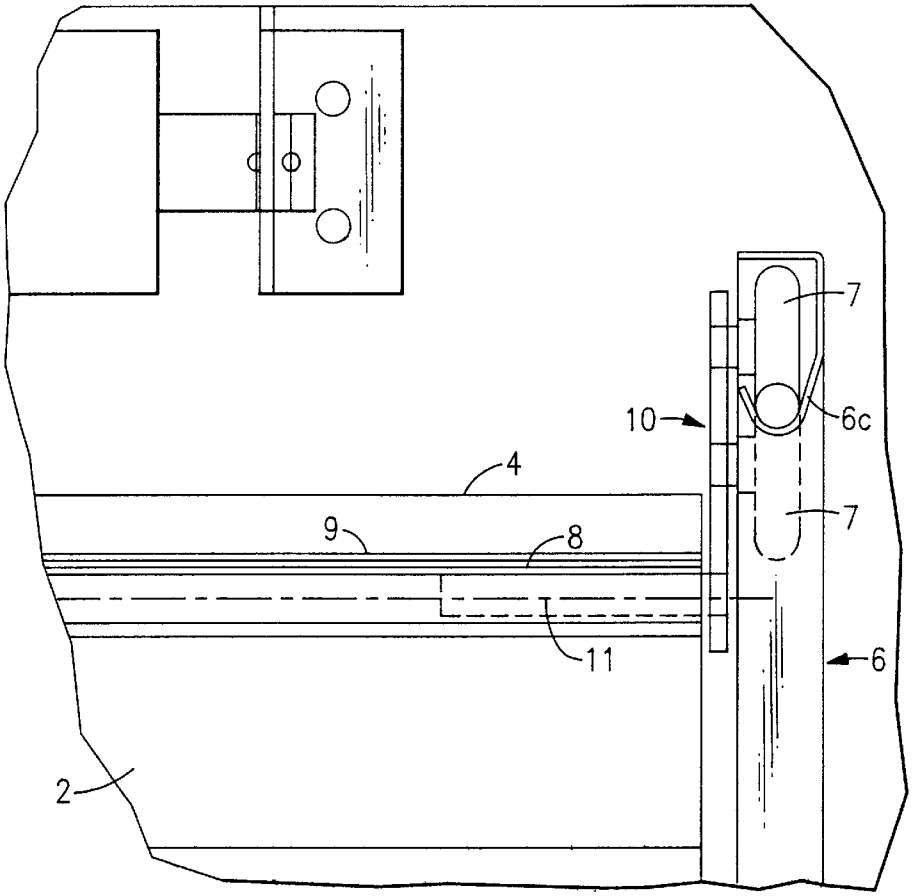
FIG. 10 is a partial longitudinal sectional plan view showing the mounting of the assembly.

Referring to FIGS. 4 and 10, the top panel (2A) is intended to be coupled by connecting rods (10) or equivalent to the drive system of the door. To achieve this, the top part of the top panel (2*a*) has a box-section form (2A-1) established over its entire length and receiving an integral moulded profiled section (2A-2) with a spherical groove of the above-mentioned type with a front opening (2A-3) and an inner cavity (2A-4) allowing the positioning and centering of a transverse connecting bar (11). The latter is placed at the end of the two rods (10) linked to the drive mechanism. These rods (10) are arranged with a slot or slit (10*a*) making it possible to insert the roller pin (7*a*) which moves along the rails. The bar (11) is connected to the end of the (10) in any known appropriate manner. This bar (11) is fitted and clipped into cavity (2A-4) whereas a rider (8) of the same type as mentioned previously is itself fitted in and adjusts itself to the bar and profile (2A-2) with a spherical groove.

Also, the top end of the top panel (2A) preferably includes a recessed plate (12) allowing the positioning of a seal (13).

In the lower part of the door, a section (14) fitting on the bottom panel (2B) over its entire length is separately mounted. This section has an externally protruding spherical shape (14*a*) of the type described above which interlocks and fixes on the bottom end of the panel (2B) with use of a closing rider (8).

The sectional door described above has many advantages. In particular, the following points are emphasised:

ease with which the panels and rollers can be replaced in the event of damage, straightforward mounting of riders (8 and 9), protection of said rollers and their pin, ease with which panels can be assembled.

The panels can be made of plastic or other materials such as aluminium with the use of appropriate dies.

What is claimed is:

1. A sectional door assembly comprising:

a plurality of panels consecutively coupled together, each said panel having at least integral one profiled end form over at least a portion of a length thereof, in which two end forms define between consecutively coupled panels an open-ended swivel joint;

moving means associated with said coupled panels for allowing said coupled panels to be moved between a vertical position and a horizontal position in order to allow door opening and door closing;

connecting bars associated with said moving means to allow moving of all of said coupled panels, said at least one end form having an interior profile sized to allow the positioning and housing of said connecting bars over at least a portion of the length of said profile; and at least one profiled matching part, said end forms when coupled being arranged to allow the reception and interlocking of said at least one profiled matching part constituting a rider made in one or more parts over the length of said coupled panels and forming a cover to close the open-ended swivel joint, said plurality of panels including a top panel, a bottom panel and a predetermined number of intermediately coupled panels therebetween, said intermediately coupled panels each having a first end form and a second end form, said first end form including a partially spherical section defined by a pair of ends, wherein interior and exterior surfaces of said partially spherical section define a housing, each of said ends of said partially spherical section extending from a side edge of said panel, one of said ends of said partially spherical section protruding from one end of said panel while the other of said ends of said partially spherical section extends to an outside plane of the panel, in which said second end form includes a curved interior section having a radius corresponding to a radius of the exterior surface of the partially spherical section of the first end form of an adjacently coupled panel, constituting a support and reference plane, said interior section being prolonged on the outside by an open ended spherical shaped protruding part having an opening and an arcuate slot, said arcuate slot being bordered on one side by said curved interior portion and on an opposite side by an exterior surface of said protruding part, said arcuate slot forming a housing for the protruding end of said first end form, wherein the open ends of said partially spherical section and said protruding part face the outside plane of said panels when consecutive panels are in axial alignment after said first and second end forms are coupled together, in which the partially spherical section of the first end form further includes a bottom interior portion, said interior bottom portion presenting a projecting curvilinear form for forming the seat of a roller pin, the inside diameter of said partially spherical section allowing the positioning, centering and retention of said roller pin, and in which said first and second end forms, when coupled, define an opening sized for receiving at least one profiled matching part, said at least one profiled matching part having a substantially U-shaped profile and including a pair of elastically deformable wings and an outside portion having a partially spherical profile, said outside portion interlocking in the opening defined in said coupled end forms to close the swivel joint.

2. A sectional door according to claim 1, said door further comprising: a pair of profiled matching parts disposed over the length of the swivel joints of the consecutive coupled panels, said profiled matching parts forming end riders disposed over a length corresponding approximately to the length of the roller pin; and an intermediate rider having a length which is greater than the length of said end riders wherein the end riders are initially engaged in the swivel joints of a pair of consecutive panels beyond the end of the roller pins, and are moved by sliding in order to envelop the roller pins, the intermediate rider being positioned over the remainder of the length of the swivel joints of the consecutive panels to complete and immobilize the assembly.

3. A sectional door according to claim 2, including connection means for connection of said top panel to a door drive system, said top panel presenting in an upper part a box-section form for receiving an integral molded profiled section, said molded profiled section having a spherical groove with a front opening and an inner cavity allowing the positioning and centering of a connecting bar associated with means connecting at least one rider being inserted and engaged on the profiled section.

4. A sectional door according to claim 1, wherein a section fitting on the bottom panel is inserted in the bottom part of the door, said bottom fitting section presenting a open-ended spherical form, said door including a closing rider element which is interlocked and fixed in the open end of said spherical form.

* * * * *